US005096331A

United States Patent [19]

Raymond

[11] Patent Number: 5,096,331

[45] Date of Patent: Mar. 17, 1992

[54] METHOD AND APPARATUS FOR HEATING A PAVING SCREED VIA LIQUID CIRCUIT HEAT TRANSFER

[75] Inventor: Larry Raymond, Pierce County, Wash.

[73] Assignee: Carlson Paving Products, Inc., Tacoma, Wash.

[21] Appl. No.: 577,615

[22] Filed: Sep. 4, 1990

[51] Int. Cl.[5] ..... E01C 19/22; F28D 15/00

[52] U.S. Cl. ..... 404/118; 165/104.19; 165/108

[58] Field of Search ..... 404/92, 91, 95, 96, 404/118, 114; 62/23; 426/388, 453; 165/35

[56] References Cited

U.S. PATENT DOCUMENTS 3,557,672 1/1971 Shurtz et al. ..... 404/95
3,602,113 8/1971 Davin et al. ..... 404/84
4,124,352 11/1978 Cutler ..... 404/75
4,319,856 3/1982 Jeppson ..... 404/79
4,407,605 10/1983 Wirtgen ..... 404/77
4,507,015 3/1985 Furukawa et al. ..... 404/102
4,714,374 12/1987 Mihara ..... 404/91
4,765,772 8/1988 Benedetti et al. ..... 404/77
4,818,140 4/1989 Carlson ..... 404/118

*Primary Examiner*—Ramon S. Britts
*Assistant Examiner*—Nancy Connolly
*Attorney, Agent, or Firm*—Seed and Berry

[57] ABSTRACT

A paving machine screed is heated by pumping fluid from a reservoir tank mounted on the screed to a flow restrictor so that the fluid is heated by a pressure drop across the at the flow restrictor and returned to the tank for heat transfer to the screed.

12 Claims, 4 Drawing Sheets

METHOD AND APPARATUS FOR HEATING A PAVING SCREED VIA LIQUID CIRCUIT HEAT TRANSFER

TECHNICAL FIELD

The present invention relates to asphalt paving machines, and particularly to means for preheating primary screed sections and screed extenders.

BACKGROUND OF THE INVENTION

The screeds on asphalt paving machines must be preheated to about 175° F. to 200° F. before paving commences to keep the hot asphalt from congealing on the sale face of the screeds. In the past, the preheating has been accomplished by oil or propane burners mounted on the moldboard and directly heating the top surface of the screeds. When using such burners, particular care must be taken to avoid overheating since this can result in permanent warping of the screed.

U.S. Pat. No. 4,818,140 discloses a screed extension which is slide-mounted on the moldboard of an asphalt paver of the floating screed type. The screed extension is divided into inner and outer screed sections which are hinged together so that the outer screed section can be swung upwardly relative to the inner screed section to engage and shape a sloping berm. Prior to the present invention, screed extensions have not been independently heated because the preheating system normally used for the main screed has not been considered to be adaptable for screed extensions.

SUMMARY OF THE INVENTION

The present invention provides an improved preheating system for primary and extension screeds which eliminates the use of oil or propane burners. Basic to the improved system is the fact that an orifice induced drop in the pressure of circulating high pressure liquid will result in heating the liquid. In accordance with the present invention, a low-pressure reservoir is mounted in direct contact with the top surface of the screed. Liquid from the reservoir is pressurized by a pump and circulated through a flow restrictor to create a pressure drop in the range of about 700 to 800 psi, for example. This pressure drop can be adjusted to result in an output oil temperature of about 275° F. which normally is sufficient to establish the desired screed temperature of about 200° F.

DETAILED DESCRIPTION OF THE INVENTION

Figure 1:
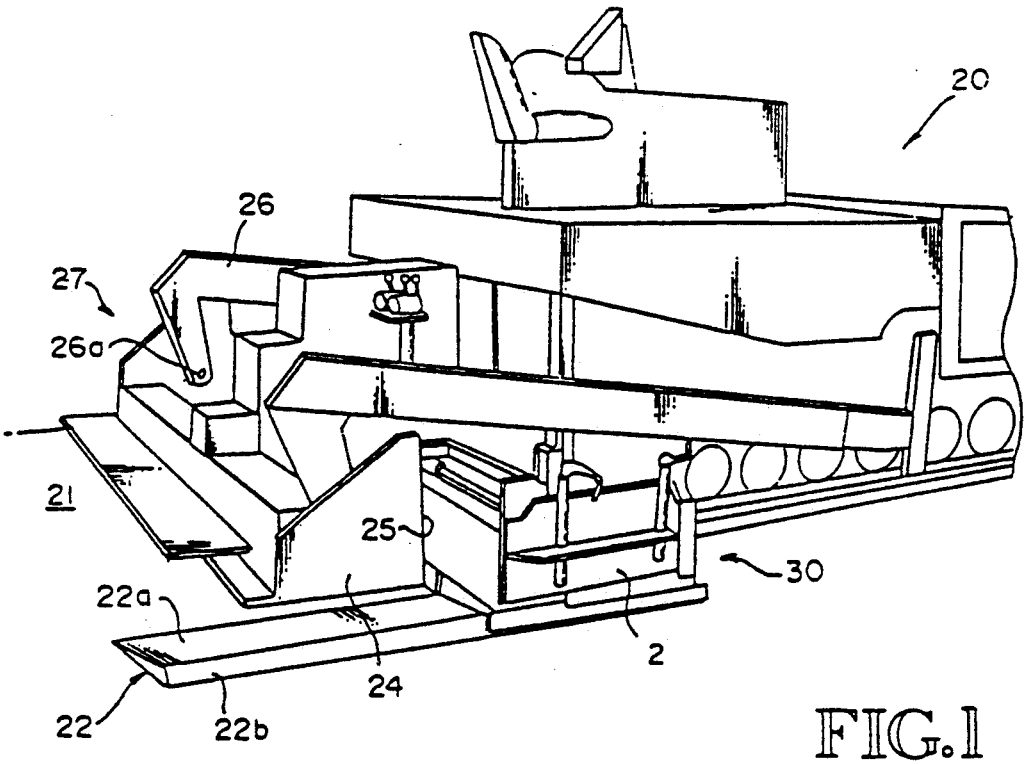
FIG. 1 is a perspective view of a paver equipped with a screed extender and embodying the present invention.

Referring to FIG. 1, a conventional asphalt paving machine 20 of the floating screed type is illustrated operating to spread and grade an asphalt road mix on a road surface to form a paving mat 21 with a shoulder berm 22 to the right having a sloped upper face **22*a* and generally vertical outer face 22*b*. The machine 20 has a main screed 24 extending rearwardly from an upright moldboard 25. Elevation of the screed 24 is determined by adjustment of a pair of tow arms 26 pivotally connected at 26*a* to a supporting frame 27** for the moldboard and screed.

The machine 20 is shown with a screed extender 30 of the type, for example, disclosed in U.S. Pat. No. 4,818,140, and, namely, an extender having inner and outer screed sections connected together so that the outer screed section can form the sloped face **22*a* of the berm 22. Asphalt mix carried by the machine 20 is spread laterally in front of the moldboard 25 by augers (not shown) which are spaced forwardly of the moldboard 25 sufficiently to permit the screed extenders 30 to be mounted between the main screed 24** and the augers.

Figure 2:
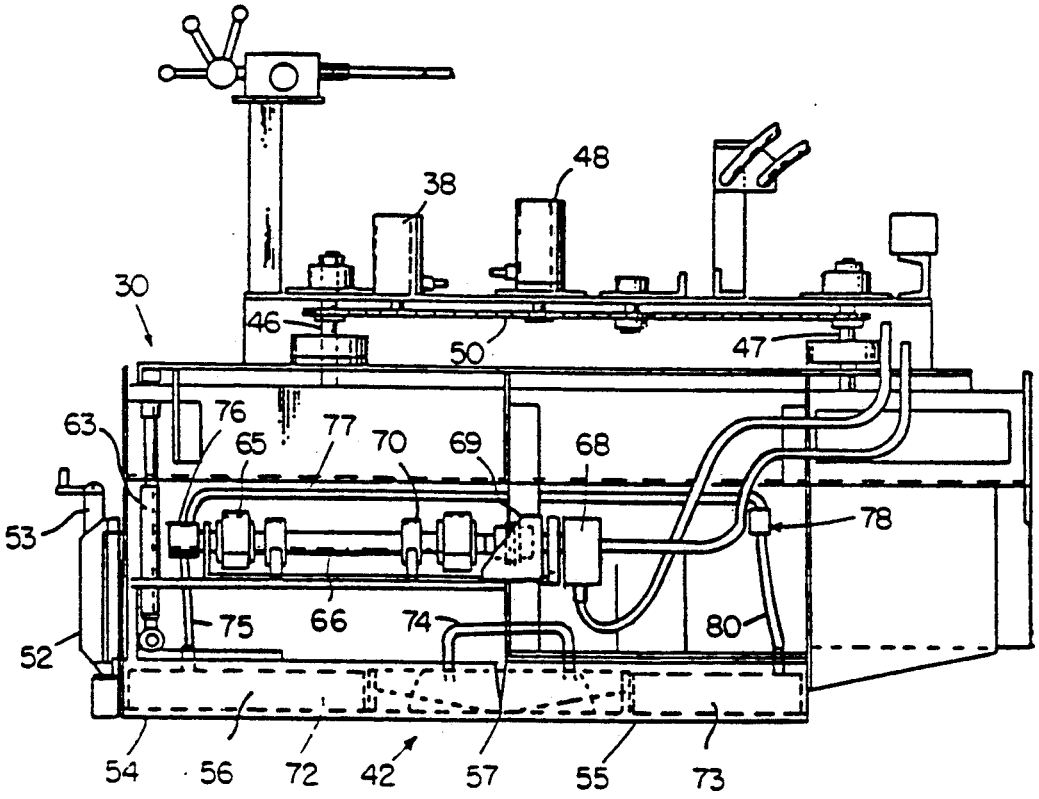
FIG. 2 is a front elevational view of the screed extender with the front cover removed.
Figure 3:
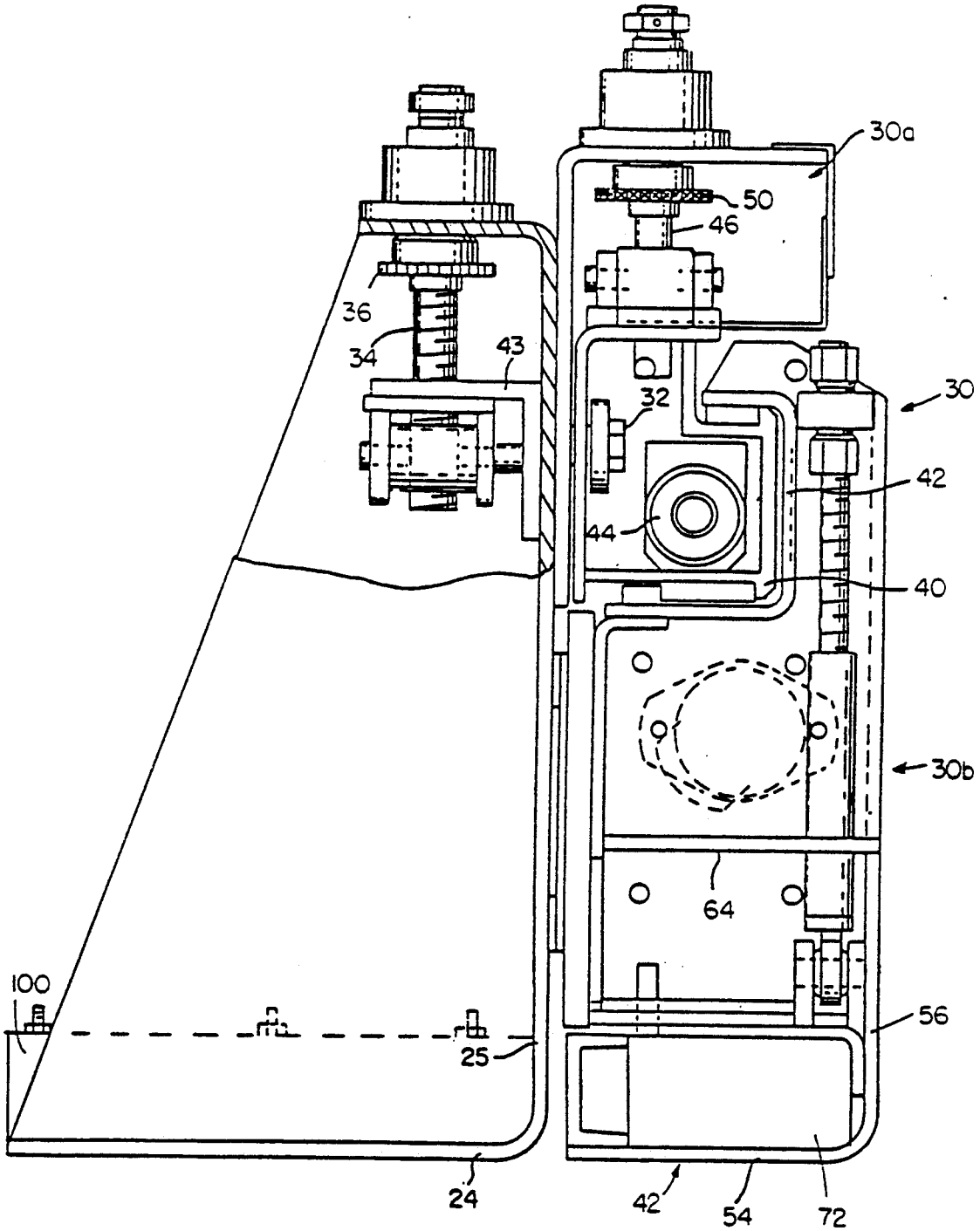
FIG. 3 is an outer end view of the screed extender without end plates.
Figure 6:
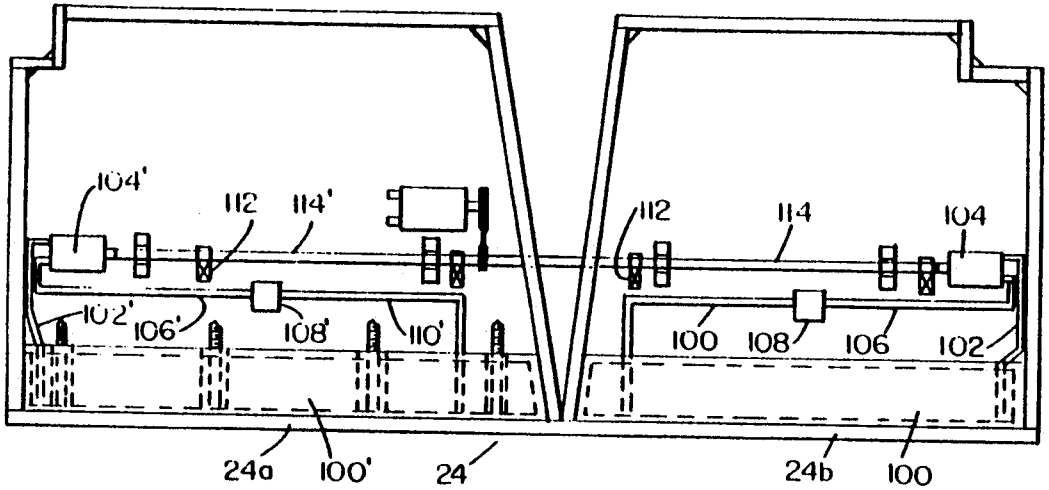
FIG. 6 is a rear elevational view illustrating the screed heating system applied to the primary screed.

The screed extender 30, like that shown in U.S. Pat. No. 4,818,140 and with the present invention applied thereto, is shown in FIGS. 2, 3, and 6. The extender 30 has a non-sliding frame assembly **30*a* mounted on main moldboard 25 to pivot on bolt 32 for slope adjustment relative to the main screed 24 by action of a jackscrew 34 which is turned by a chain and sprocket drive 36 from a slope-adjusting hydraulic motor 38. The non-sliding frame assembly 30*a* has a slide rail unit 40 complemented by a slide member 42 which is presented by a sliding frame assembly 30*b* on the bottom of which is mounted an articulated extension screed assembly 42. A hydraulic cylinder unit 44 housed in the slide rail unit 40 is used to extend the sliding frame assembly 30*b* relative to the non-sliding frame assembly 30*a*. Vertical adjustment of the screed extender 30 is accomplished by a pair of jackscrews 46, 47, turned in unison by a hydraulic motor 48 acting via sprockets and a chain 50. The sliding frame assembly 30*b* carries a floating end gate unit 52 which is vertically adjustable by screw jacks 53**.

The extension screed assembly 42 includes an outer screed section 54 which is pivotally mounted for upward swinging adjustment on the outer end of an inner screed section 55. The latter is fixed to the lower end of the sliding frame assembly **30*b*. Screed sections 54, 55 are suitably reinforced at the back, top, and ends, and have bottom screed portions joined at a rounded bend to front moldboard portions 56. The meeting ends of the screed sections 54, 55 are tapered to provide a swing angle having its apex 57 at the level of the sole faces of the screed sections. A hinge structure 58 (FIG. 6) which may be like that illustrated in FIGS. 8, 9 of U.S. Pat. No. 4,818,140 is mounted on the screed sections 54, 55. This hinge structure includes a center hinge block 59 which is mounted part way along its bottom side on the screed section 54, for example, and has a beveled bottom edge portion overlying the screed section 55. The ends 59*a*, 59*b* of the hinge block 59 are curved on convex arcs centered at the swing axis 57. These convex arcs are complemented by concave arcs on two pairs of hinge plates 60, 61 provided on the inner opposed faces of a pair of check plates 62 which are interconnected at one end and are fixed part way along their lower edge to the screed section 55. The portions of the hinge plates 60 and cheek plates 62 overlying the screed section 54 have a beveled undercut to permit hinge movement in conjunction with the block 59. Hinging movement between the screed sections 54, 55 is caused by operation of a screw jack 63 pivotally connected at its lower end to the outer screed section 54 and at its upper end to the slide frame 42. The sliding frame assembly 30*b* has a shelf 64 on which a pair of bearing blocks 65 are mounted for giving journal support to a shaft 66 driven by a hydraulic motor 68 at one end via a coupling 69. This motor 68 has pressure and return hoses connected to the primary hydraulic system of the pairing machine. Eccentrics 70 are mounted on the shaft 66 for vibrating the screed extension responsive to rotation of the shaft 66**.

Figure 5:
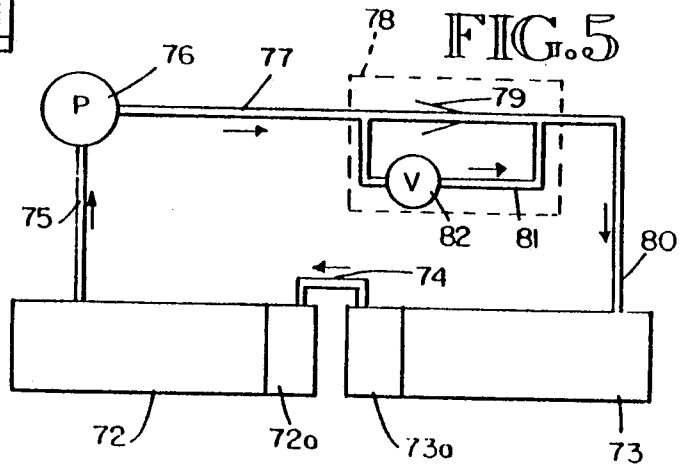
FIG. 5 is a schematic of the screed heating system on the screed extender.

The screed extension unit described above is an example of a prior art unit to which the heating system of the present invention is applicable. The basic heating system of the present invention as applied to such a unit is illustrated schematically in FIG. 5, wherein two reservoir tanks 72, 73 are bolted or otherwise secured in direct heat exchange relation with the screed sections 54, 55. If desired, the screed sections can comprise the actual bottom wall of the reservoirs 72, 73. Preferably, the reservoirs 72, 73 have inner extensions **72*a*, 73*a* on one or both sides of the hinge 58, and these extensions have a hose 74** therebetweeen for fluid connection of the reservoirs. Venting of the reservoirs may be provided as by a pressure relief valve.

Reservoir 72 connects by a hose 75 to the suction side of a pressure pump 76, which is preferably powered from the vibratory shaft 66 for compactness of arrangement. The output of the pump 76 feeds by a hose 77 to a flow restrictor unit 78 having an orifice 79 which may comprise a pressure relief valve. The flow restrictor unit discharges via a hose 80 to reservoir 73. Preferably the flow restrictor unit 78 has a bypass 81 with a temperature-controlled solenoid valve 82 thereon for bypassing the orifice 79 when the temperature of the oil in the reservoirs 68, 69 exceeds a predetermined limit. The pressure output from the pump 76 may be in the range of 800 to 1000 psi and the pressure drop across the orifice 79 may be about 740 to 940 psi. Adjustment of this pressure drop will provide an oil temperature of about 275° F. By the described system, the screed sections 54, 55 may be preheated and maintained at a temperature of about 200° F.

Figure 4:
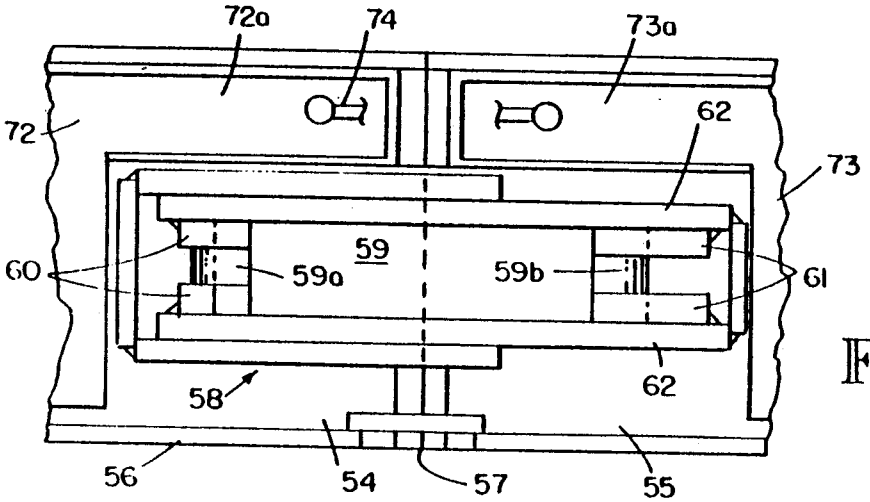
FIG. 4 is a fragmentary horizontal sectional through the screed extender directly above the hinge and reservoir tanks.
Figure 7:
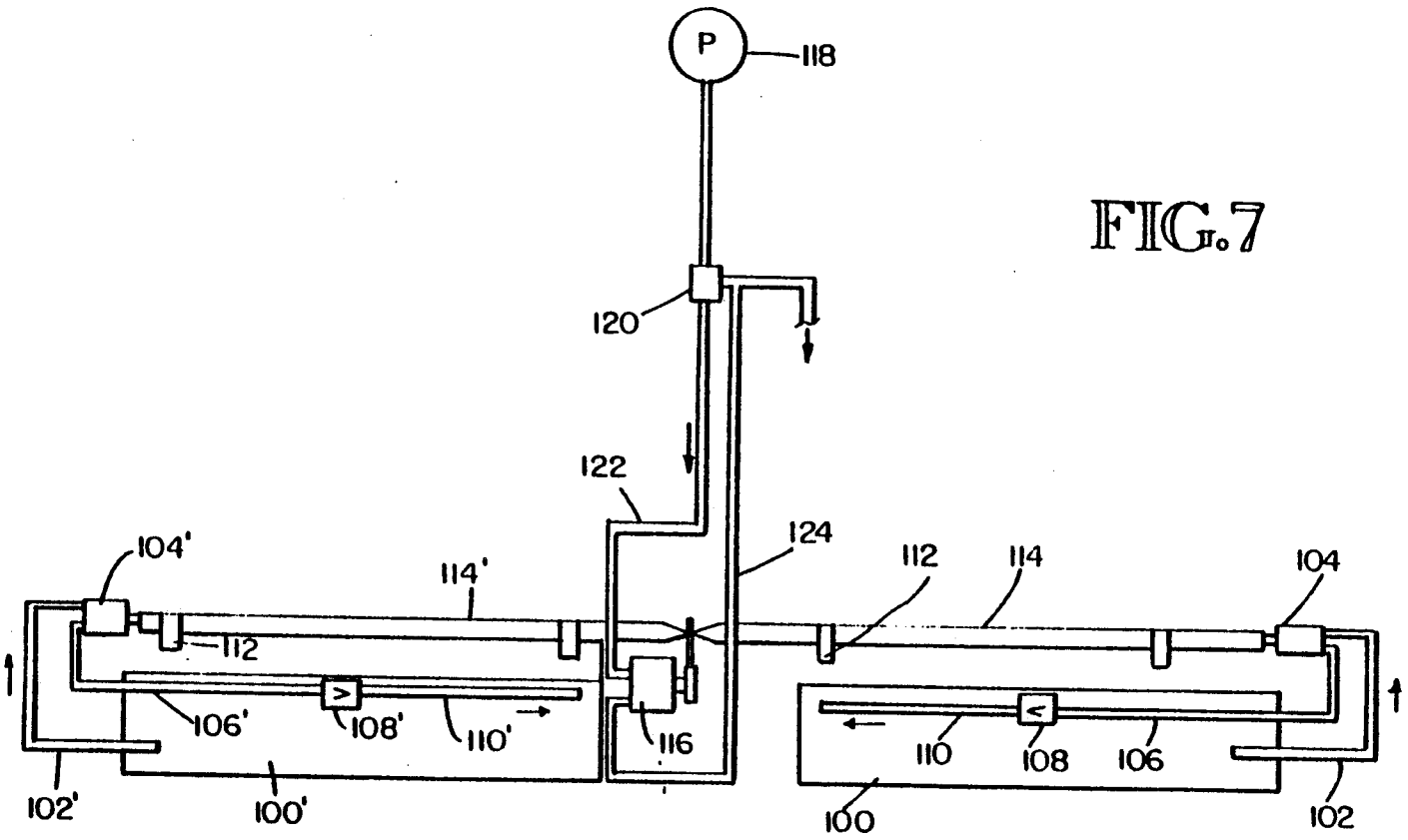
FIG. 7 is a schematic of the system in FIG. 6.

As indicated in FIGS. 4 and 7, the screed heating system of the invention can also be applied to the right and left primary floating screed sections **24*a*, 24*b* of the paving machine. For this purpose, reservoir tanks 100, 100' are mounted on the screed sections 24*a*, 24*b* and are connected by input hoses 102, 102' to pumps 104, 104'. The pressurized discharge oil from these pump is conducted by hoses 106, 106' to flow restrictor units 108, 108' like the previously described unit 78 for dropping the pressure and responsively heating the oil. The hot oil then circulates via hoses 110, 110' to the reservoir tanks 100, 100' for heating the primary screed sections 24*a*, 24*b***.

Commonly, the primary screed sections are vibrated by rotation of eccentrics 112 on shafts 114, 114' suitably coupled together and driven by a hydraulic motor 116. This motor may in turn be supplied with pressurized fluid from a general purpose pump 118 on the paving machine via a flow divider 120 and hose 122. The return hose 124 leads to a sump from which the pump 118 takes its suction. It is convenient to drive the pumps 104, 104' from the vibratory shafts 114, 114'.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. All heating system for a screed on a paving machine, comprising:

a heat exchanger on the screed;

a pump;

a flow restrictor; and a heating circuit connecting the heat exchanger, pump and flow restrictor so that fluid from the heat exchanger is pressurized by the pump to flow through the flow restrictor back to the heat exchanger and undergo a pressure drop at the flow restrictor resulting in heating of the fluid for heat transfer through the heat exchanger to the screed.

2. A heating system according to claim 1 in which said heat exchanger comprises a tank engaging the upper face of the screed.

3. A heating system according to claim 1 in which said screed is an extension screed on the paving machine.

4. A heating system according to claim 1 in which said screed comprises two screed sections hinged together for relative up and down swinging movement, and said heat exchanger comprises two tanks mounted on respective of said screed sections and connected together for fluid flow from one tank to the other in said heating circuit.

5. A heating system according to claim 1 in which said pump is a rotary pump and the paving machine has a rotary vibratory unit coupled to said pump, and means for rotating said vibratory unit and pump in unison.

6. A heating system according to claim 1 in which said heating circuit includes a bypass around said flow restrictor containing a temperature controlled valve for bypassing pressurized fluid from the pump around the flow restrictor to the heat exchanger responsive to a predetermined fluid temperature.

7. In a paving machine, comprising:

a paving machine screed having a bottom sole surface and a top surface;

a liquid circuit;

a tank in said circuit mounted on said top surface for containing a liquid;

means for heating the liquid; and means for circulating the heated liquid through said tank in said circuit for responsively heating said screed, both of said means being carried by the paving machine.

8. Apparatus according to claim 7 in which said circuit is a closed circuit for said liquid.

9. Apparatus for a paving machine, comprising:

a screed; and means including a pump and a flow restrictor in series for circulating fluid under pressure through said flow restrictor to heat said fluid, and for circulating said heated fluid at reduced pressure in heat transfer relation to said screed for responsively heating the screed.

10. Apparatus for paving machine, comprising:

a screed for a paving machine;

a vented liquid reservoir covering a major part of said screed in heat transfer relation thereto;

liquid in said reservoir;

a flow restrictor; and liquid circulating and pressurizing means for pressurizing fluid from said reservoir and forcing it through said flow restrictor and back into the reservoir.

11. A system for heating a paving machine screed, comprising:

pumping fluid from a vented reservoir tank mounted on the screed through a flow restrictor so that the fluid is heated at the flow restrictor and returned to said tank for heat transfer from the heated fluid to the screed.

12. A method for heating a screed on a paving machine, comprising:

pressurizing a returning supply of liquid;

circulating the pressurized liquid through a flow restrictor to heat the liquid during a pressure drop across the flow restrictor;

circulating the heated liquid in close proximity to the screed to transfer heat from the heated liquid to the screed; and circulating the liquid as said returning supply to be again pressurized.

* * * * *